US010012916B2

(12) United States Patent
Takamura

(10) Patent No.: US 10,012,916 B2
(45) Date of Patent: Jul. 3, 2018

(54) PHOTORECEPTOR FOR ELECTROPHOTOGRAPHY, AND PHOTORECEPTOR CARTRIDGE AND IMAGE FORMING APPARATUS EMPLOYING THE SAME

(71) Applicant: S-Printing Solution Co., Ltd., Suwon-si, Gyeonggi-do (KR)

(72) Inventor: Hiroaki Takamura, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/597,727

(22) Filed: May 17, 2017

(65) Prior Publication Data

US 2018/0120716 A1 May 3, 2018

(30) Foreign Application Priority Data

Oct. 28, 2016 (KR) ..... 10-2016-0142150

(51) Int. Cl.

| | |
|---|---|
| ***G03G 5/00*** | (2006.01) |
| ***G03G 5/06*** | (2006.01) |
| ***G03G 15/00*** | (2006.01) |
| ***G03G 5/10*** | (2006.01) |
| ***G03G 5/047*** | (2006.01) |
| ***G03G 5/05*** | (2006.01) |

(52) U.S. Cl.
CPC ..... *G03G 5/0614* (2013.01); *G03G 5/047* (2013.01); *G03G 5/0525* (2013.01); *G03G 5/0542* (2013.01); *G03G 5/0564* (2013.01); *G03G 5/0696* (2013.01); *G03G 5/102* (2013.01); *G03G 15/75* (2013.01)

(58) Field of Classification Search
CPC ..... G03G 5/0614
USPC ..... 430/58.85
See application file for complete search history.

(56) References Cited

U.S. PATENT DOCUMENTS

| | | | |
|---|---|---|---|
| 7,625,682 B2 | 12/2009 | Kanazawa et al. | |
| 9,663,447 B2 * | 5/2017 | Kondo | C07C 211/58 |

FOREIGN PATENT DOCUMENTS

| | | |
|---|---|---|
| JP | 08-202056 | 8/1996 |
| JP | 2873148 | 1/1999 |
| JP | 2003-012629 | 1/2003 |
| JP | 3990391 B2 | 10/2007 |
| JP | 5332401 | 8/2013 |

* cited by examiner

*Primary Examiner* — Mark A Chapman
(74) *Attorney, Agent, or Firm* — Staas & Halsey LLP

(57) ABSTRACT

Provided is a photoreceptor for electrophotography, having high sensitivity and high-speed response performance, and which prevents accumulation of residual potential even when used repeatedly. Also, provided are a photoreceptor cartridge and an image forming apparatus, each employing the photoreceptor.

15 Claims, 2 Drawing Sheets

PHOTORECEPTOR FOR ELECTROPHOTOGRAPHY, AND PHOTORECEPTOR CARTRIDGE AND IMAGE FORMING APPARATUS EMPLOYING THE SAME

CROSS-REFERENCE TO RELATED APPLICATION

This application claims the benefit of Korean Patent Application No. 10-2016-0142150, filed on Oct. 28, 2016, in the Korean Intellectual Property Office, the disclosure of which is incorporated herein in its entirety by reference.

BACKGROUND

1. Field

The present disclosure relates to electrophotography, and more particularly, to a photoreceptor for electrophotography, and a photoreceptor cartridge and an image forming apparatus employing the same.

2. Description of the Related Art

Electrophotographic technology enables printing of high-quality images at high speeds. Therefore, electrophotographic technology is widely used in, for example, image forming apparatuses such as a copy machine and a printer. Electrophotographic technology requires a photoreceptor for forming an electrostatic latent image. An inorganic photoreceptor or an organic photoreceptor may be used as the photoreceptor. The organic photoreceptor is provided with an organic photosensitive layer formed from organic materials. Since the organic photosensitive layer is formed from organic materials, it may be very easily formed by using a pollution-free preparation process. Thus, the organic photoreceptor may be very easily manufactured.

Recently, the use of image forming apparatuses has further expanded. In addition, there is a demand for images of much higher quality. In particular, there is a demand for a high-performance image forming apparatus capable of printing images with fewer defects, higher definition, and higher resolution. Further, in order to obtain an electrophotographic image forming apparatus with high performance and low cost, it is necessary that the photoreceptor is manufactured with high sensitivity and at a low cost. In order to increase sensitivity of the photoreceptor, there is a requirement for an optimized charge generating material and a charge transporting material which well matches with a charge generating material. To reduce a production cost of the photoreceptor, the charge transporting material should be capable of exhibiting superior charge mobility even when used in a smaller amount.

Low-molecular-weight enamine-based compounds are known as common charge transporting materials. A typical enamine-based compound should be added in a large amount to a photosensitive layer in order to obtain an organic photoreceptor having excellent electrical properties. Further, organic photoreceptors that include typical enamine-based charge transporting materials have remarkable accumulation of residual potential when they are used repeatedly.

SUMMARY

The present disclosure provides a photoreceptor for electrophotography, having high sensitivity and high-speed response performance, and which prevents accumulation of residual potential even when used repeatedly. Further, the present disclosure provides a photoreceptor cartridge and an image forming apparatus, each employing the photoreceptor.

According to an aspect of the present disclosure, a photoreceptor for electrophotography includes a conductive support; and a photosensitive layer disposed on the conductive support, the photosensitive layer including a binder resin, a charge generating material, and at least one charge transporting material represented by the following Chemical Formula 1:

<Chemical Formula 1>

(1)

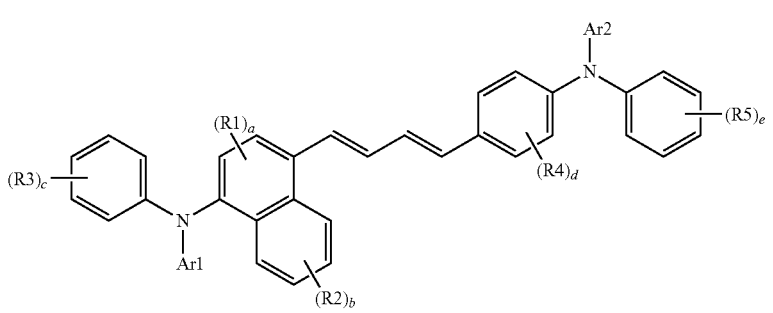

wherein Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
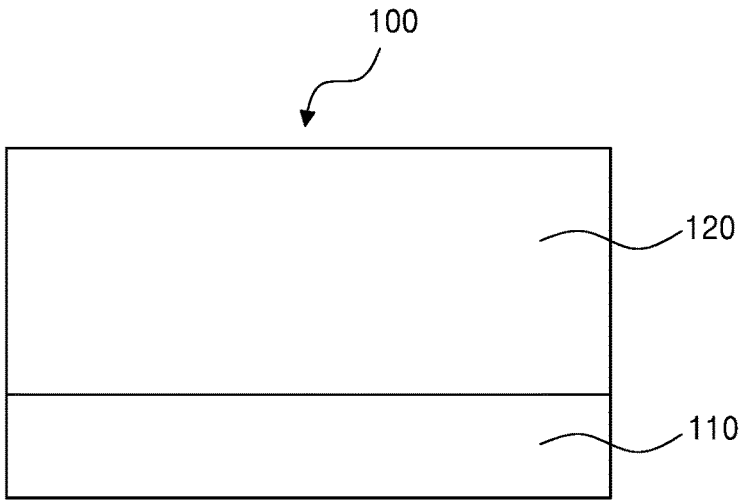
FIG. 1 is a schematic cross-sectional view of an embodiment of a photoreceptor for electrophotography according to an aspect of the present disclosure.

Hereinafter, an embodiment of a photoreceptor for electrophotography according to an aspect of the present disclosure will be described in more detail with reference to FIG. 1. FIG. 1 is a schematic cross-sectional view of an embodiment of a photoreceptor for electrophotography 100 according to an aspect of the present disclosure. In FIG. 1, the photoreceptor for electrophotography 100 includes a conductive support 110, and a photosensitive layer 120 disposed on the conductive support 110.

The photosensitive layer 120 includes a binder resin, a charge generating material, and at least one charge transporting material represented by the following Chemical Formula 1:

<Chemical Formula 1>

(1)

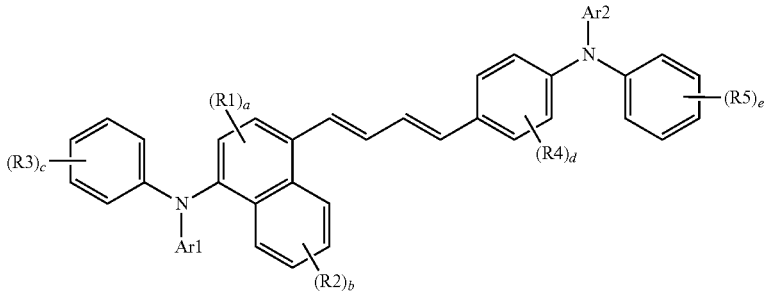

wherein Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

The enamine-based charge transporting material represented by Chemical Formula 1 enables the photosensitive layer to show improvements in photo-sensitivity, response performance, and residual potential. Further, the enamine-based charge transporting material represented by Chemical Formula 1 may effectively prevent accumulation of residual potential in the photosensitive layer when the photoreceptor for electrophotography is repeatedly used.

The enamine-based charge transporting material represented by Chemical Formula 1 may be synthesized by a known method of using a compound represented by the following Chemical Formula 2 (CAS No. 49678-04-8) as a starting material:

<Chemical Formula 2>

(2)

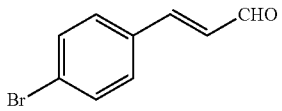

In another embodiment, at least one of Ar1 and Ar2 of Chemical Formula 1 may be an alkyl group having 1 to 10 carbon atoms, or a phenyl group substituted or unsubstituted with a halogen atom.

In still another embodiment, at least one of Ar1 and Ar2 of Chemical Formula 1 may be a group represented by the following Chemical Formula 3:

<Chemical Formula 3>

(3)

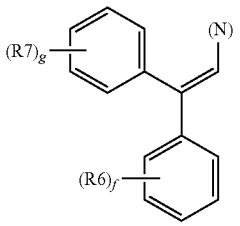

wherein R6 and R7 are each independently a halogen atom or an alkyl group having 1 to 10 carbon atoms, and f and g are each independently an integer of 0 to 3.

In still another embodiment, the photosensitive layer 120 may further include an additional charge transporting material, in addition to the charge transporting material of Chemical Formula 1. Non-limiting examples of the additional charge transporting material may include a carbazole derivative, a hydrazone derivative, an aromatic amine derivative, a stilbene derivative, a butadiene derivative, or a combination thereof.

Non-limiting examples of the charge generating material of the photosensitive layer 120 may include inorganic charge generating materials such as selenium, a selenium-containing alloy, or cadmium sulfide; organic charge generating materials such as a phthalocyanine pigment, an azo pigment, a dithioketo-pyrrolo-pyrrole pigment, a squalene (squalirium) pigment, a quinacridone pigment, an indigo pigment, a perylene pigment, a polycyclic quinone pigment, an anthanthrone pigment, or a benzimidazole pigment; or a combination thereof.

Particularly, the phthalocyanine pigment may exhibit high sensitivity to laser light having a relatively long wavelength. Particularly, the azo pigment may exhibit sufficient sensitivity to white light or laser light having a relatively short wavelength.

Non-limiting examples of the phthalocyanine pigment may include a metal-free phthalocyanine compound; a crystalline phthalocyanine compound, to which a metal (e.g., copper, indium, gallium, tin, titanium, zinc, vanadium, silicon, or germanium), a metal oxide, a metal halide, a metal hydroxide, or a metal alkoxide is coordinated; or a combination thereof. Specific examples of the phthalocyanine pigment may include a crystalline X-type phthalocyanine compound, a τ-type metal-free phthalocyanine compound, an A-type (another name: β-type) titanyl phthalocyanine compound (another name: oxytitanium phthalocyanine), a B-type (another name: α-type) titanyl phthalocyanine compound, a D-type (another name: γ-type) titanyl phthalocyanine compound, a vanadyl phthalocyanine compound, a chloroindium phthalocyanine compound, a II-type chlorogallium phthalocyanine compound, a V-type hydroxy gallium phthalocyanine compound, a G-type μ-oxo-gallium phthalocyanine dimer, an I-type μ-oxo-gallium phthalocyanine dimer, a II-type μ-oxo-aluminum phthalocyanine dimer, or a combination thereof. The phthalocyanine pigment may include, particularly, the A-type (β-type) titanyl phthalocyanine compound, the B-type (α-type) titanyl phthalocyanine compound, the D-type (γ-type) titanyl phthalocyanine compound, the II-type chlorogallium phthalocyanine compound, the V-type hydroxy gallium phthalocyanine compound, the G-type μ-oxo-gallium phthalocyanine dimer, or a combination thereof. The phthalocyanine pigment may include, more particularly, oxytitanium phthalocyanine having main diffraction peaks at a Bragg angle (2θ±0.2°) of 27.2° in an X-ray diffraction spectrum obtained using CuKα characteristic X-rays; oxytitanium phthalocyanine having main diffraction peaks at 9.3°, 13.2°, 26.2°, and 27.1°; dichlorotin phthalocyanine having main diffraction peaks at 8.5°, 12.2°, 13.8°, 16.9°, 22.4°, 28.4°, and 30.1°; hydroxy gallium phthalocyanine having main diffraction peaks at 7.5°, 9.9°, 12.5°, 16.3°, 18.6°, 25.1°, and 28.3°; chlorogallium phthalocyanine having main diffraction peaks at 7.4°, 16.6°, 25.5°, and 28.3°; or a combination thereof. The phthalocyanine pigment may include, much more particularly, oxytitanium phthalocyanine having main diffraction peaks at 27.2°. The phthalocyanine pigment may include, even much more particularly, oxytitanium phthalocyanine having main diffraction peaks at 9.5°, 24.1°, and 27.2°. The phthalocyanine pigment may be a single phthalocyanine compound. Alternatively, the phthalocyanine pigment may be a mixture of various phthalocyanine compounds. Alternatively, the phthalocyanine pigment may be a mixture of phthalocyanine compounds in different crystal states.

Non-limiting examples of the azo pigment may include a monoazo pigment, a diazo pigment, a triazo pigment, a polyazo pigment, or a combination thereof. Particularly, the azo pigment may include the diazo pigment, the triazo pigment, or a combination thereof.

When the content of the charge generating material in the photosensitive layer 120 is too low, the photoreceptor for electrophotography 100 may not have sufficient sensitivity. When the content of the charge generating material in the photosensitive layer 120 is too high, charging properties and sensitivity of the photoreceptor for electrophotography 100 may be reduced. The content of the charge generating material in the photosensitive layer 120 may be, for example, about 0.5 parts by weight or more, or 1 part by weight or more, based on 100 parts by weight of the binder resin. The content of the charge generating material in the photosensitive layer 120 may be, for example, about 50 parts by weight or less, or 20 parts by weight or less, based on 100 parts by weight of the binder resin.

The charge generating material may have an average particle size of, for example, about 1 μm or less or about 0.5 μm or less.

Non-limiting examples of the binder resin of the photosensitive layer 120 may include a butadiene resin; a styrene resin; polyvinyl acetates; polyvinyl chlorides; an acrylic acid ester resin; a methacrylic acid ester resin; a vinyl alcohol resin; PVB (polyvinyl butyrals); PVF (polyvinyl fluorides); partially modified polyvinyl acetals; polycarbonates; polyesters; polyarylates; polyamides; polyurethanes; a cellulose ester resin; a phenoxy resin; a silicon resin; an epoxy resin; poly(N-vinylcarbazole)s; or a combination thereof. The binder resin of the photosensitive layer 120 may include, particularly, polycarbonates, polyarylates, or a combination thereof. The binder resin of the photosensitive layer 120 may be cured with a curing agent.

In an embodiment, as shown in FIG. 1, the photosensitive layer 120 may be a single-layered photosensitive layer including the binder resin, the charge generating material, and the charge transporting material. In the single-layered photosensitive layer, a lower limit of the content of the charge transporting material represented by Chemical Formula 1 in the photosensitive layer 120 may be, for example, about 20 parts by weight or about 30 parts by weight, based on 100 parts by weight of the binder resin. When the content of the charge transporting material represented by Chemical Formula 1 in the photosensitive layer 120 is about 30 parts by weight or more, based on 100 parts by weight of the binder resin, accumulation of residual potential in the photoreceptor may be remarkably prevented. Further, when the content of the charge transporting material represented by Chemical Formula 1 in the photosensitive layer 120 is about 30 parts by weight or more, based on 100 parts by weight of the binder resin, stability of the photoreceptor against repeated use, and charge mobility of the photoreceptor may be remarkably improved. In the single-layered photosensitive layer, an upper limit of the content of the charge transporting material represented by Chemical Formula 1 in the photosensitive layer 120 may be, for example, about 150 parts by weight, about 110 parts by weight, about 70 parts by weight, or about 50 parts by weight, based on 100 parts by weight of the binder resin. When the content of the charge transporting material represented by Chemical Formula 1 in the photosensitive layer 120 is about 150 parts by weight or less, based on 100 parts by weight of the binder resin, thermal stability of the photosensitive layer 120 may be remarkably improved. When the content of the charge transporting material represented by Chemical Formula 1 in the photosensitive layer 120 is about 110 parts by weight or less, based on 100 parts by weight of the binder resin, compatibility between the charge transporting material and the binder resin may be remarkably improved. When the content of the charge transporting material represented by Chemical Formula 1 in the photosensitive layer 120 is about 70 parts by weight or less, based on 100 parts by weight of the binder resin, abrasion resistance of the photosensitive layer 120 may be remarkably improved. When the content of the charge transporting material represented by Chemical Formula 1 in the photosensitive layer 120 is about 50 parts by weight or less, based on 100 parts by weight of the binder resin, scratch resistance of the photosensitive layer 120 may be remarkably improved. A variety of content ranges may be created by combinations of the examples of the lower limit of the content of the charge transporting material and the examples of the upper limit of the content of the charge transporting material. A thickness of the photosensitive layer 120 may be, for example, about 5 μm or more, or about 10 μm or more. The thickness of the photosensitive layer 120 may be, for example, about 100 μm or less, or about 50 μm or less. A variety of thickness ranges may be created by combinations of the examples of the lower limit of the thickness and the examples of the upper limit of the thickness. When the thickness of the photosensitive layer 120 is about 10 μm to about 45 μm, a lifetime of the photoreceptor 100 may be remarkably increased, and stability of images may be also remarkably increased. When the thickness of the photosensitive layer 120 is about 10 μm to about 30 μm, images with higher resolution may be easily obtained.

Figure 2:
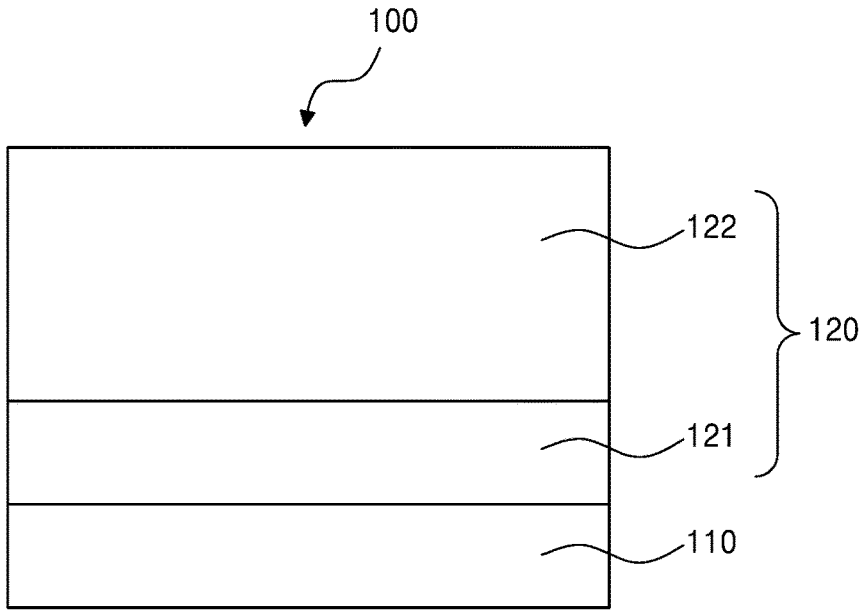
FIG. 2 is a schematic cross-sectional view of an embodiment of a photoreceptor employing a multilayered photosensitive layer according to another aspect.

In another embodiment, as shown in FIG. 2, the photosensitive layer 120 may be a multilayered photosensitive layer including a charge generating layer 121 including the binder resin and the charge generating material; and a charge transporting layer 122 including the binder resin and the charge transporting material. FIG. 2 is a schematic cross-sectional view of a photoreceptor employing the multilayered photosensitive layer according to another embodiment.

A lower limit of the content of the charge transporting material represented by Chemical Formula 1 in the charge transporting layer 122 may be, for example, about 20 parts by weight or about 30 parts by weight, based on 100 parts by weight of the binder resin. When the content of the charge transporting material represented by Chemical Formula 1 in the charge transporting layer 122 is about 30 parts by weight or more, based on 100 parts by weight of the binder resin, accumulation of residual potential in the photoreceptor for electrophotography 100 may be remarkably prevented. Further, when the content of the charge transporting material represented by Chemical Formula 1 in the charge transporting layer 122 is about 30 parts by weight or more, based on 100 parts by weight of the binder resin, stability of the photoreceptor for electrophotography 100 against repeated use, and charge mobility of the photoreceptor for electrophotography 100, may be remarkably improved. An upper limit of the content of the charge transporting material represented by Chemical Formula 1 in the charge transporting layer 122 may be, for example, about 150 parts by weight, about 110 parts by weight, about 70 parts by weight, or about 50 parts by weight, based on 100 parts by weight of the binder resin. When the content of the charge transporting material represented by Chemical Formula 1 in the charge transporting layer 122 is about 150 parts by weight or less, based on 100 parts by weight of the binder resin, thermal stability of the photosensitive layer 120 may be remarkably improved. When the content of the charge transporting material represented by Chemical Formula 1 in the charge transporting layer 122 is about 110 parts by weight or less, based on 100 parts by weight of the binder resin, compatibility between the charge transporting material and the binder resin may be remarkably improved. When the content of the charge transporting material represented by Chemical Formula 1 in the charge transporting layer 122 is about 70 parts by weight or less, based on 100 parts by weight of the binder resin, abrasion resistance of the photosensitive layer 120 may be remarkably improved. When the content of the charge transporting material represented by Chemical Formula 1 in the charge transporting layer 122 is about 50 parts by weight or less, based on 100 parts by weight of the binder resin, scratch resistance of the photosensitive layer 120 may be remarkably improved. In the charge transporting layer 122, a variety of content ranges may be created by combinations of the examples of the lower limit of the content of the charge transporting material and the examples of the upper limit of the content of the charge transporting material.

In the embodiment of FIG. 2, the charge generating layer 121 is disposed between the conductive support 110 and the charge transporting layer 122. However, in another embodiment, the charge transporting layer 122 may be disposed between the conductive support 110 and the charge generating layer 121.

A thickness of the charge transporting layer 122 may be, for example, about 5 μm to about 50 μm. When the thickness of the charge transporting layer 122 is about 10 μm to about 45 μm, a lifetime of the photoreceptor for electrophotography 100 may be remarkably increased, and stability of images may also be remarkably increased. When the thickness of the charge transporting layer 122 is about 10 μm to about 30 μm, images of a higher resolution may be easily obtained.

A content of the charge generating material in the charge generating layer 121 may be, for example, about 0.5 parts by weight or more, or about 1 part by weight or more, based on 100 parts by weight of the binder resin. The content of the charge generating material in the charge generating layer 121 may be, for example, about 50 parts by weight or less or 20 parts by weight or less, based on 100 parts by weight of the binder resin.

A thickness of the charge generating layer 121 may be, for example, about 5 μm to about 50 μm.

Non-limiting examples of the binder resin of the charge generating layer 121 or the charge transporting layer 122 may include a butadiene resin; a styrene resin; polyvinyl acetates; polyvinyl chlorides; an acrylic acid ester resin; a methacrylic acid ester resin; a vinyl alcohol resin; PVB (polyvinyl butyrals); PVF (polyvinyl fluorides); partially modified polyvinyl acetals; polycarbonates; polyesters; polyarylates; polyamides; polyurethanes; a cellulose ester resin; a phenoxy resin; a silicon resin; an epoxy resin; poly(N-vinylcarbazoles); or a combination thereof. The binder resin of the photosensitive layer 120 may include, particularly, polycarbonates, polyarylates, or a combination thereof. The binder resin of the charge generating layer 121 or the charge transporting layer 122 may be cured with a curing agent.

Non-limiting examples of the conductive support 110 may be as follows: a metal such as aluminum, aluminum alloy, stainless steel, iron, or nickel; a resin containing conductive particles such as a metal, carbon, or tin oxide; and a resin, glass, or paper, the surface of which has a deposited layer of or is coated with a conductive material such as aluminum, nickel, or indium tin oxide (ITO). Non-limiting examples of the conductive support 110 may be in the form of, for example, a drum, a sheet, or a belt. The surface of the conductive support 110 may be coated with a conductive material having an appropriate resistance value to control electrical conductivity of the surface of the conductive support 110 or a surface property of the conductive support 110, or to cover a defect of the surface of the conductive support 110. When aluminum alloy is used as the conductive support 110, the surface of the conductive support 110 may be subjected to anodic oxidation treatment. The anodic oxidized surface of the conductive support 110 may be also subjected to sealing treatment. An anodic oxide film on the surface of the conductive support 110 may have, for example, an average thickness of about 20 μm or less, or about 7 μm or less. The surface of the conductive support 110 may be smooth or may be roughened by a cutting method or a polishing treatment. In order to obtain the conductive support 110 at a low cost, a drawn tube "as drawn" without applying a cutting treatment thereto may be also used. For example, the conductive support 110 manufactured by, for example, a drawing process, an impact process, or an ironing process may be cut so that foreign materials or defects on the surface thereof are removed.

In another embodiment, the photoreceptor for electrophotography 100 may further include an undercoating layer (not shown) disposed between the conductive support 110 and the photosensitive layer 120. The undercoating layer may improve adhesiveness between the conductive support 110 and the photosensitive layer 120. The undercoating layer may block charge mobility between the conductive support 110 and the photosensitive layer 120. The undercoating layer may be, for example, a binder resin; or a binder resin in which metal oxide particles are dispersed. A non-limiting example of the metal oxide particles used in the undercoating layer may be metal oxide particles containing one metal element, such as titanium oxide, aluminum oxide, silicon oxide, zirconium oxide, zinc oxide, or iron oxide, or a non-limiting example of the metal oxide particles used in the undercoating layer may be metal oxide particles containing two or more metal elements, such as calcium titanate, strontium titanate, or barium titanate. The metal oxide particles used in the undercoating layer may include one kind of a particle or a mixture of two or more kinds of particles. In still another embodiment, the surface of the metal oxide particles (e.g., titanium oxide particles, zinc oxide particles, etc.) may be coated with an inorganic material such as tin oxide, aluminum oxide, antimony oxide, zirconium oxide, or silicon oxide; or an organic material such as stearic acid, polyols, or polysilicones. The titanium oxide particles may be, for example, rutile crystal particles, anatase crystal particles, brookite crystal particles, amorphous crystal particles, or a combination thereof. An average particle size of the metal oxide particles may be, for example, about 1 nm or more, or about 10 nm or more. The average particle size of the metal oxide particles may be, for example, about 100 nm or less, or about 25 nm or less. The binder resin to be used in the undercoating layer may be, for example, a phenoxy resin, an epoxy resin, polyvinyl pyrrolidones, polyvinyl alcohols, caseins, polyacrylic acids, celluloses, gelatins, starches, polyurethanes, polyimides, polyamides, or a combination thereof. The binder resin may be cured with a curing agent. A cured alkyl melamine resin or a cured alkyd melamine resin may have very excellent pressure resistance. An amount of the metal oxide particles of the undercoating layer may be, for example, about 10 parts by weight to about 500 parts by weight, based on 100 parts by weight of the binder resin. A thickness of the undercoating layer may be, for example, about 0.1 μm to about 20 μm. The undercoating layer may further include an antioxidant.

In still another embodiment, the photosensitive layer 120 may further include an additive, for example, an antioxidant, a plasticizer, a ultraviolet absorber, an electron-withdrawing compound, a leveling agent, etc., in order to improve a film-forming property, flexibility, a coating property, contamination resistance, gas resistance, light resistance, etc.

In still another embodiment, the photoreceptor may further include a protective layer disposed on the photosensitive layer so as to protect the photosensitive layer (including the single-layered photosensitive layer and the multilayered photosensitive layer) against wear damage or prevent the photosensitive layer from deterioration due to a discharge product generated from a charging device.

In still another embodiment, a layer disposed on an outermost layer of the photoreceptor may further include, for example, a fluorine-based resin or a silicon resin so that frictional resistance of the surface of the photoreceptor is reduced or abrasion of the photoreceptor is inhibited.

Each of the layers constituting the photoreceptor for electrophotography 100 may be formed by applying a coating solution, which is obtained by dissolving or dispersing components of the corresponding layer in a solvent, on the conductive support 110 by, for example, a dip coating, spray coating, nozzle coating, bar coating, roll coating, a blade coating method, etc.

Non-limiting examples of the solvent or dispersion medium used in the coating solution may include alcohol-based solvents such as methanol, ethanol, propanol, or 2-methoxyethanol; ether-based solvents such as tetrahydrofuran, 1,4-dioxane, or dimethoxyethane; ester-based solvents such as methyl formate or ethyl acetate; ketone-based solvents such as acetone, methyl ethyl ketone, or cyclohexanone; aromatic hydrocarbon-based solvents such as benzene, toluene, or xylene; chlorinated hydrocarbon-based solvents such as dichloromethane, chloroform, 1,2-dichloroethane, 1,1,2-trichloroethane, 1,1,1-trichloroethane, tetrachloroethane, 1,2-dichloropropane, or trichloroethylene; nitrogen-containing solvents such as n-butylamine, isopropanolamine, diethylamine, triethanolamine, ethylenediamine, or triethylenediamine; and aprotic polar solvents such as acetonitrile, N-methylpyrrolidone, N,N-dimethylformamide, or dimethylsulfoxide. These solvents may be used alone or in a mixture of two or more thereof.

A solid content (a content of components excluding a solvent) of the coating solution for the single-layered photosensitive layer or the coating solution for the charge transporting layer of the multilayered photosensitive layer may be, for example, about 10% by weight or more. The solid content of the coating solution for the single-layered photosensitive layer or the coating solution for the charge transporting layer of the multilayered photosensitive layer may be, for example, about 40% by weight or less or about 35% by weight or less. Viscosity of the coating solution for the single-layered photosensitive layer or the coating solution for the charge transporting layer of the multilayered photosensitive layer may be, for example, about 50 mPa·s to about 400 mPa·s. A solid content of the coating solution for the charge generating layer of the multilayered photosensitive layer may be, for example, about 1% by weight or more. The solid content of the coating solution for the charge generating layer of the multilayered photosensitive layer may be, for example, about 15% by weight or less or about 10% by weight or less. Viscosity of the coating solution for the charge generating layer of the multilayered photosensitive layer may be, for example, about 0.1 mPa·s to about 10 mPa·s.

An image forming apparatus according to another aspect of the present disclosure may include the photoreceptor for electrophotography 100; a charging device for charging the photoreceptor for electrophotography; a light exposure device for exposing the photoreceptor for electrophotography to light to form an electrostatic latent image on the photoreceptor for electrophotography; a developing device for developing the electrostatic latent image formed on the photoreceptor for electrophotography using a toner to form a toner image; and a cleaning device for removing residual toner on the photoreceptor for electrophotography after transferring the toner image onto an image receiving material, in which the photoreceptor for electrophotography 100 includes the conductive support 110, and the photosensitive layer disposed on the conductive support 110, the photosensitive layer including the binder resin, the charge generating material, and at least one charge transporting material represented by the following Chemical Formula 1:

<Chemical Formula 1>

(1)

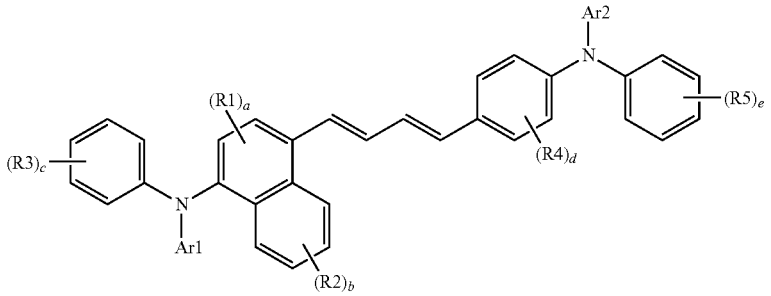

wherein Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

Figure 3:
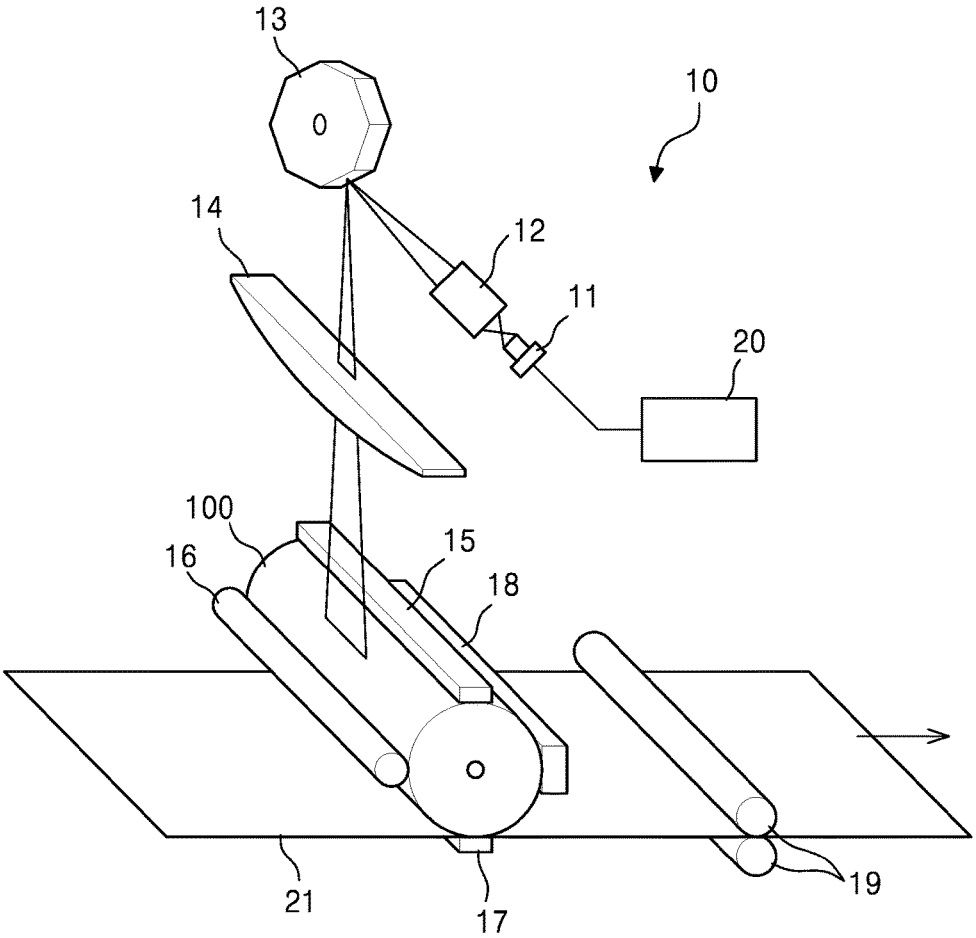
FIG. 3 is a schematic view of an embodiment of an image forming apparatus according to still another aspect.

FIG. 3 is a schematic view of an image forming apparatus according to an embodiment. The image forming apparatus 10 is provided with a semiconductor laser (image exposure device) 11 as a means for exposing an image to light. A laser beam modulated with image information by a control circuit 20 is parallelized through a compensation optical system 12 after emission, and reflected by a polygon mirror 13 to produce a scanning motion. The laser beam is focused on the surface of the photoreceptor for electrophotography 100 by an f-θ lens 14 and the image information is exposed thereto. Since the photoreceptor for electrophotography 100 is charged in advance by a charging device 15 which is a charging means, an electrostatic latent image is formed on the surface of the photoreceptor for electrophotography 100 by the light exposure. Next, the electrostatic latent image formed on the photoreceptor for electrophotography 100 is developed with a toner by a developing device 16 which is a developing means for forming a toner image, thereby performing a visible imaging process. This visible image is transferred onto an image receiving material 21 such as paper by a transferring device 17 which is a transferring means, and fixed by a fixing device 19 which is a fixing means, thereby being provided as a printed material. The photoreceptor for electrophotography 100 may be repeatedly used by removing residual toner or toner components on the surface thereof using a cleaning device 18 which is a cleaning means.

The photoreceptor for electrophotography 100 illustrated in FIG. 3 is drum-shaped and is driven to rotate at a predetermined circumferential speed around the axis. The circumferential surface of the photoreceptor for electrophotography 100 may be evenly charged with a predetermined negative or positive electric potential by the charging device during rotation. A voltage to be applied is, for example, a vibration voltage obtained by superimposing an AC voltage on a DC voltage. Although a drum-shaped photoreceptor for electrophotography is described herein, a sheet- or belt-shaped photoreceptor for electrophotography may be also used.

The charging device 15 is a contact-type charging device, in which a charging member such as a charging roller, a charging brush, etc. is brought into contact with the photoreceptor for charging. A non-contact-type charging roller or a corona charging device such as a scorotron charging device or a corotron charging device may be used as the charging means, in addition to the charging device 15 illustrated in FIG. 3.

Further, a photoreceptor cartridge may be configured as an integrated cartridge by combining the photoreceptor for electrophotography 100 with one or more members of the charging device 15, the developing device 13, etc. in the image forming apparatus, and this photoreceptor cartridge may be configured to be freely removable from the main body of the image forming apparatus which may be, for example, a copying machine or a laser beam printer.

Accordingly, the photoreceptor cartridge according to still another aspect of the present disclosure includes the photoreceptor for electrophotography 100; and at least one of the charging device 15 and the developing device 16, the photoreceptor for electrophotography 100 including the conductive support 110; and the photosensitive layer 120 disposed on the conductive support 110, the photosensitive layer 120 including the binder resin, the charge generating material, and at least one of the charge transporting material represented by the following Chemical Formula 1:

<Chemical Formula 1>

(1)

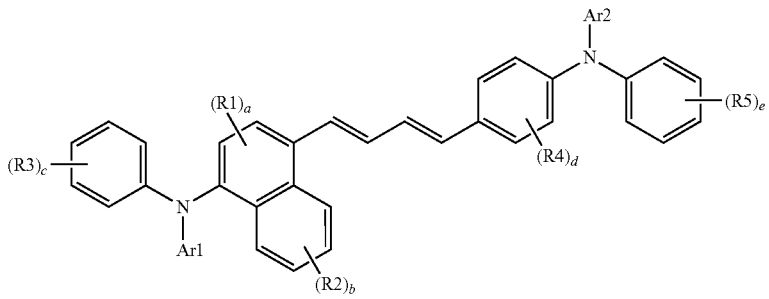

wherein Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

The photoreceptor for electrophotography provided in embodiments of the present disclosure may have high sensitivity and high-speed response performance. In addition, the photoreceptor for electrophotography provided in embodiments of the present disclosure may prevent accumulation of residual potential even when it is repeatedly used.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. Expressions such as "at least one of", when preceding a list of elements, modify the entire list of elements and do not modify the individual elements of the list.

Hereinafter, the present invention will be described in more detail with reference to Examples. However, these Examples are provided for illustrative purposes only, and the invention is not intended to be limited by these Examples.

EXAMPLES

Example 1

80 parts by weight of zinc oxide powder of which a surface was hydrophobized (purchased from Sakai Chemical, Japan, product name: MZY-303S), 16 parts by weight of a melamine resin (purchased from DIC, Japan, product name: G-821-60), and 4 parts by weight of an acrylic resin (purchased from DIC, Japan, product name: AA-804) were dispersed in a methyl ethyl ketone solvent by a ball mill to obtain a coating solution for forming an undercoating layer having a solid content of 43% by weight.

The coating solution for forming the undercoating layer was applied to an aluminum-made cylinder having an outer diameter of 30 mm, a length of 255 mm, and a wall thickness of 0.75 mm, by an immersion method, and then dried at 145° C. for 60 minutes to form the undercoating layer having a thickness of 5.0 μm.

Separately, a coating solution for forming a charge generating layer was prepared by the following method. 56 parts by weight of a gallium phthalocyanine dimer (purchased from Orient Chemical Industries, product name: OPTRON GPL-G); 44 parts by weight of Y-type oxytitanium phthalocyanine having main diffraction peaks at a Bragg angle (2θ±0.2°) of 27.2° in the X-ray diffraction spectrum obtained using CuKα characteristic X-rays; 23 parts by weight of a polyvinyl butyral resin of a high polymerization degree (purchased from Sekisui Chemical, product name: BX-5); and 23 parts by weight of a polyvinyl butyral resin of a middle polymerization degree (purchased from Sekisui Chemical, product name: BM-2) were dispersed in a 1,2-dimethoxyethane solvent by a paint shaker to prepare the coating solution for forming the charge generating layer having a solid content of 4.0% by weight.

The coating solution for forming the charge generating layer was applied onto the undercoating layer by an immersion method, and dried at 100° C. for 30 minutes, thereby forming the charge generating layer having a thickness of 0.4 μm.

Separately, 30 parts by weight of a charge transporting material of the following Chemical Formula 4 and 100 parts by weight of bisphenol Z-type polycarbonate were dissolved in a dichloromethane solvent to obtain a coating solution for forming the charge transporting layer having a solid content of 20% by weight:

<Chemical Formula 4>

(4)

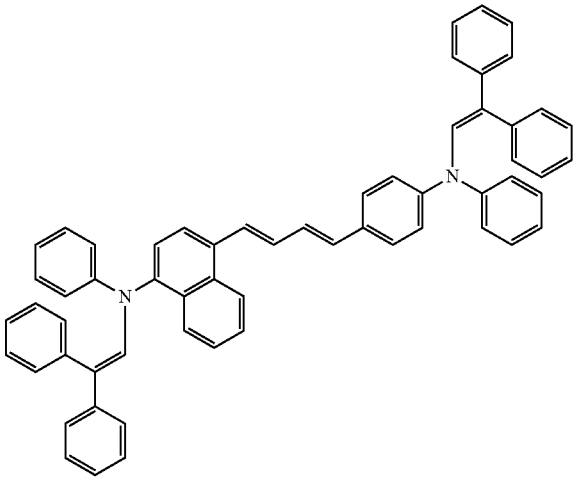

The coating solution for forming the charge transporting layer was applied onto the charge generating layer by an immersion method, and dried at 125° C. for 30 minutes, thereby forming the charge transporting layer having a thickness of 20 μm. Consequently, a photoreceptor of Example 1, in which the undercoating layer, the charge generating layer, and the charge transporting layer were sequentially coated on the aluminum cylinder, was obtained.

Example 2

A photoreceptor of Example 2 was obtained in the same manner as in Example 1, except that a charge transporting material of the following Chemical Formula 5 was used instead of the charge transporting material of Chemical Formula 4:

<Chemical Formula 5>

(5)

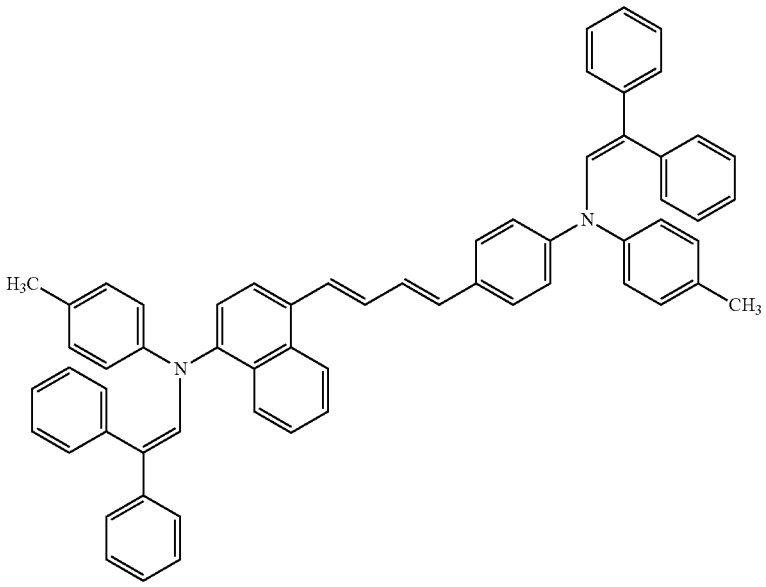

Example 3

A photoreceptor of Example 3 was obtained in the same manner as in Example 1, except that a charge transporting material of the following Chemical Formula 6 was used instead of the charge transporting material of Chemical Formula 4:

<Chemical Formula 6>

(6)

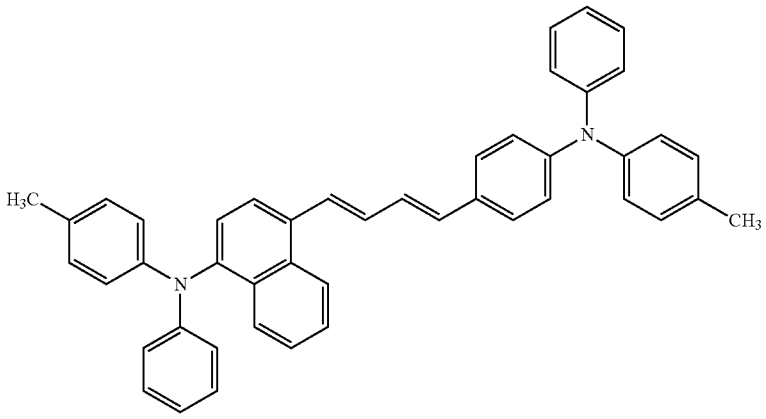

Example 4

A photoreceptor of Example 4 was obtained in the same manner as in Example 1, except that the charge transporting material of Chemical Formula 4 was used in an amount of 40 parts by weight instead of 30 parts by weight.

Example 5

A photoreceptor of Example 5 was obtained in the same manner as in Example 2, except that the charge transporting material of Chemical Formula 5 was used in an amount of 40 parts by weight instead of 30 parts by weight.

Example 6

A photoreceptor of Example 6 was obtained in the same manner as in Example 3, except that the charge transporting material of Chemical Formula 6 was used in an amount of 40 parts by weight instead of 30 parts by weight.

Comparative Example 1

A photoreceptor of Comparative Example 1 was obtained in the same manner as in Example 1, except that 30 parts by weight of a charge transporting material of the following Chemical Formula 7 was used instead of the charge transporting material of Chemical Formula 4:

<Chemical Formula 7>

(7)

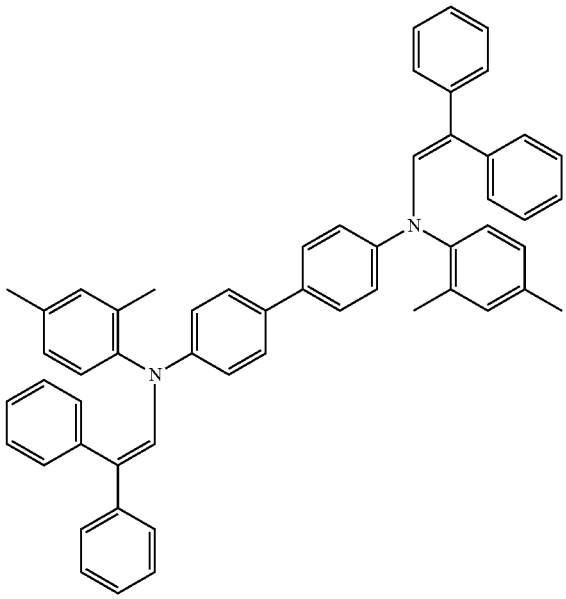

Comparative Example 2

A photoreceptor of Comparative Example 2 was obtained in the same manner as in Example 1, except that 30 parts by weight of a charge transporting material of the following Chemical Formula 8 was used instead of the charge transporting material of Chemical Formula 4:

<Chemical Formula 8>

(8)

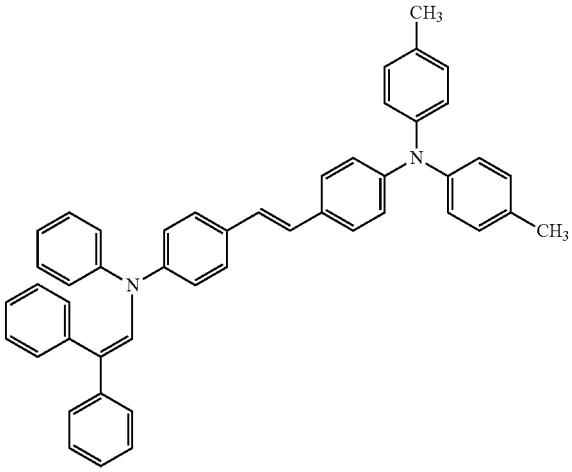

Comparative Example 3

A photoreceptor of Comparative Example 3 was obtained in the same manner as in Comparative Example 1, except the charge transporting material of the Chemical Formula 7 was used in an amount of 40 parts by weight instead of 30 parts by weight.

Comparative Example 4

A photoreceptor of Comparative Example 4 was obtained in the same manner as in Comparative Example 2, except the charge transporting material of the Chemical Formula 8 was used in an amount of 40 parts by weight instead of 30 parts by weight.

<Test of Electrical Characteristics of Photoreceptors>

Each of the photoreceptors of Examples 1 to 6 and Comparative Examples 1 to 4 was installed in an apparatus for evaluating electrophotographic characteristics (manufactured by GENTEC, CYNTHIA 56KSS), and electrical characteristics of the photoreceptors were measured by applying a cycle of charging, light-exposing, electric potential measuring, and discharging thereto. The results are summarized in Table 1.

In each case, the photoreceptor was rotated at a speed of 100 rpm at a temperature of 23° C. and a relative humidity of 55%, and charged to have an initial surface potential of 600 V. The photoreceptor was irradiated with 780-nm monochromatic light which was obtained by filtering light emitted from a halogen lamp with an interference filter. VL1, which is a surface potential of the photoreceptor at irradiation energy of 1.5 $\mu J/cm^2$, was determined. The time (response time) from light-exposure to potential measurement was 67 msec.

VL2, which is a surface potential of the photoreceptor at irradiation energy of 1.5 $\mu J/cm^2$, was determined in the same manner as above, except that the rotation speed of the photoreceptor was set to 190 rpm. In this regard, the time (response time) from light-exposure to potential measurement was 35 msec.

Next, the photoreceptor was discharged using a discharge light (LED light of 660 nm), and then a residual surface potential Vr of the photoreceptor was determined. Thereafter, the rotation speed of the photoreceptor was set to 190 rpm, and a cycle of charging, light-exposing, and discharging was repeated 6,000 times, and a residual surface potential $Vr_{6000}$ of the photoreceptor was determined.

TABLE 1

| Example | CTM | CTM parts by weight | VL1 (−V) | VL2 (−V) | Vr (−V) | $Vr_{6000}$ (−V) |
|---|---|---|---|---|---|---|
| Example 1 | Chemical Formula 4 | 30 | 50 | 63 | 25 | 30 |
| Example 2 | Chemical Formula 5 | 30 | 47 | 61 | 24 | 31 |
| Example 3 | Chemical Formula 6 | 30 | 51 | 65 | 25 | 33 |
| Example 4 | Chemical Formula 4 | 40 | 42 | 48 | 20 | 23 |
| Example 5 | Chemical Formula 5 | 40 | 41 | 47 | 20 | 23 |
| Example 6 | Chemical Formula 6 | 40 | 44 | 51 | 21 | 26 |
| Comparative Example 1 | Chemical Formula 7 | 30 | 60 | 85 | 26 | 70 |
| Comparative Example 2 | Chemical Formula 8 | 30 | 62 | 88 | 27 | 95 |
| Comparative Example 3 | Chemical Formula 7 | 40 | 48 | 68 | 23 | 55 |
| Comparative Example 4 | Chemical Formula 8 | 40 | 50 | 71 | 22 | 72 |

<Test of Images>

A halftone image was printed using a color laser printer (Samsung Electronics, CLX-8650ND) equipped with 4 color cartridges provided with the photoreceptor of Example 1, and as a result, a uniform and satisfactory image was obtained. A halftone image was also printed using a color laser printer (Samsung Electronics, CLX-8650ND) equipped with 4 color cartridges provided with the photoreceptor of Example 4, and as a result, a uniform and satisfactory image was obtained.

These results suggest that the photoreceptor including the charge transporting material of the present disclosure has satisfactory electrical characteristics and may be suitably used in an apparatus for forming an electrophotographic image.

In detail, the photoreceptors of Examples 1 to 6 exhibited sufficiently low surface potentials under VL2 measurement conditions of a short response time, compared to those of the Comparative Examples. In addition, the photoreceptors of Examples 1 to 6 remarkably prevented accumulation of residual surface potential due to repeated use, compared to those of the Comparative Examples.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A photoreceptor for electrophotography comprising:

a conductive support, and a photosensitive layer disposed on the conductive support, the photosensitive layer comprising:

a binder resin, a charge generating material, and at least one charge transporting material having a composition represented by the following Chemical Formula 1:

<Chemical Formula 1>

(1)

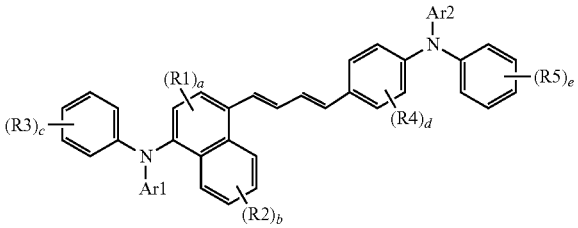

wherein:

Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

2. The photoreceptor for electrophotography of claim 1, wherein at least one of Ar1 and Ar2 of Chemical Formula 1 is an alkyl group having 1 to 10 carbon atoms, or a phenyl group which is substituted or unsubstituted with a halogen atom.

3. The photoreceptor for electrophotography of claim 1, wherein at least one of Ar1 and Ar2 of Chemical Formula 1 is a group represented by the following Chemical Formula 3:

<Chemical Formula 3>

(3)

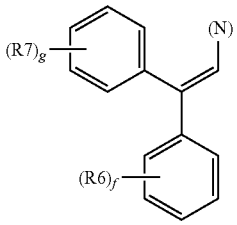

wherein:

R6 and R7 are each independently a halogen atom, or an alkyl group having 1 to 10 carbon atoms, and f and g are each independently an integer of 0 to 3.

4. The photoreceptor for electrophotography of claim 1, wherein:

the photosensitive layer is a single-layered photosensitive layer, and the charge transporting material is present in the photosensitive layer at a content of 30 parts by weight to 50 parts by weight, based on 100 parts by weight of the binder resin.

5. The photoreceptor for electrophotography of claim 1, wherein:

the photosensitive layer is a multilayered photosensitive layer comprising:

a charge generating layer comprising the binder resin and the charge generating material, and a charge transporting layer comprising the binder resin and the charge transporting material; and the charge transporting material is present in the charge transporting layer at a content of 30 parts by weight to 50 parts by weight, based on 100 parts by weight of the binder resin in the charge transporting layer.

6. An image forming apparatus comprising:

a photoreceptor for electrophotography;

a charging device for charging the photoreceptor;

a light exposure device for exposing the photoreceptor to light to form an electrostatic latent image on the photoreceptor;

a developing device for developing the electrostatic latent image formed on the photoreceptor using toner to form a toner image; and a cleaning device for removing residual toner on the photoreceptor after transferring the toner image onto an image receiving material, wherein the photoreceptor comprises:

a conductive support; and a photosensitive layer disposed on the conductive support, the photosensitive layer comprising:

a binder resin, a charge generating material, and at least one charge transporting material having a composition represented by the following Chemical Formula 1:

<Chemical Formula 1>

(1)

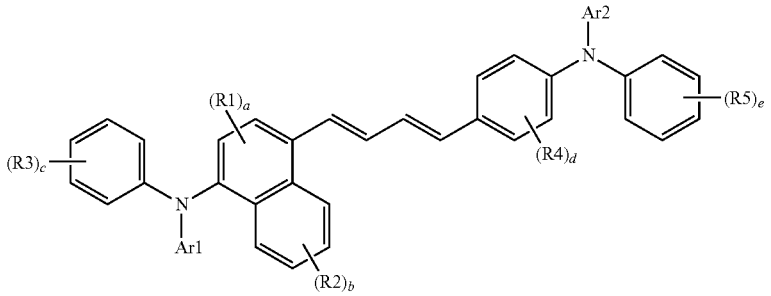

wherein:

Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

7. The image forming apparatus of claim 6, wherein at least one of Ar1 and Ar2 of Chemical Formula 1 is an alkyl group having 1 to 10 carbon atoms, or a phenyl group which is substituted or unsubstituted with a halogen atom.

8. The image forming apparatus of claim 6, wherein at least one of Ar1 and Ar2 of Chemical Formula 1 is a group represented by the following Chemical Formula 3:

<Chemical Formula 3>

(3)

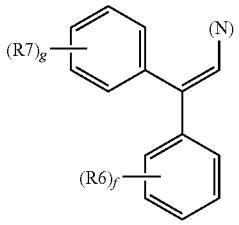

wherein:

R6 and R7 are each independently a halogen atom, or an alkyl group having 1 to 10 carbon atoms, and f and g are each independently an integer of 0 to 3.

9. The image forming apparatus of claim 6, wherein:

the photosensitive layer is a single-layered photosensitive layer, and the charge transporting material is present in the photosensitive layer at a content of 30 parts by weight to 50 parts by weight, based on 100 parts by weight of the binder resin.

10. The image forming apparatus of claim 6, wherein:

the photosensitive layer is a multilayered photosensitive layer comprising:

a charge generating layer comprising the binder resin and the charge generating material, and a charge transporting layer comprising the binder resin and the charge transporting material; and the charge transporting material is present in the charge transporting layer at a content of 30 parts by weight to 50 parts by weight, based on 100 parts by weight of the binder resin in the charge transporting layer.

11. A photoreceptor cartridge comprising:

a photoreceptor for electrophotography, and at least one of a charging device and a developing device, wherein:

the photoreceptor for electrophotography comprises:

a conductive support; and a photosensitive layer disposed on the conductive support, the photosensitive layer comprising:

a binder resin, a charge generating material, and at least one charge transporting material having a composition represented by the following Chemical Formula 1:

<Chemical Formula 1>

(1)

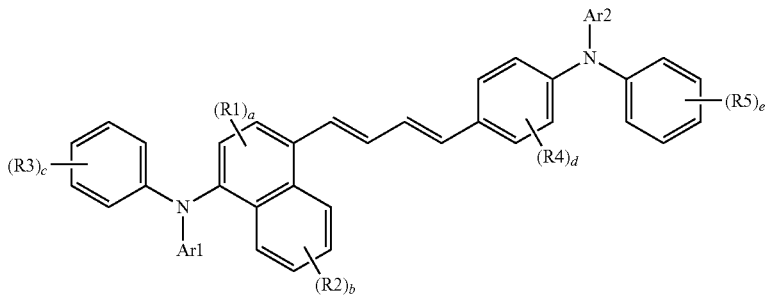

wherein:

Ar1 and Ar2 are each independently an alkyl group having 1 to 10 carbon atoms, or an aryl group having 6 to 18 carbon atoms which is substituted or unsubstituted with a halogen atom, R1 to R5 are each independently a halogen atom or an alkyl group having 1 to 10 carbon atoms, a is an integer of 0 to 2, and b to e are each independently an integer of 0 to 3.

12. The photoreceptor cartridge of claim 11, wherein at least one of Ar1 and Ar2 of Chemical Formula 1 is an alkyl group having 1 to 10 carbon atoms, or a phenyl group which is substituted or unsubstituted with a halogen atom.

13. The photoreceptor cartridge of claim 11, wherein at least one of Ar1 and Ar2 of Chemical Formula 1 is a group represented by the following Chemical Formula 3:

<Chemical Formula 3>

(3)

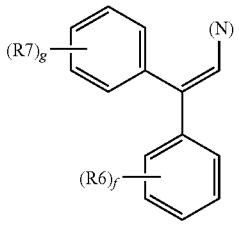

wherein:

R6 and R7 are each independently a halogen atom, or an alkyl group having 1 to 10 carbon atoms, and f and g are each independently an integer of 0 to 3.

14. The photoreceptor cartridge of claim 11, wherein:

the photosensitive layer is a single-layered photosensitive layer, and the charge transporting material is present in the photosensitive layer at a content of 30 parts by weight to 50 parts by weight, based on 100 parts by weight of the binder resin.

15. The photoreceptor cartridge of claim 11, wherein:

the photosensitive layer is a multilayered photosensitive layer comprising:

a charge generating layer comprising the binder resin and the charge generating material, and a charge transporting layer comprising the binder resin and the charge transporting material; and the charge transporting material present in the charge transporting layer at a content of 30 parts by weight to 50 parts by weight, based on 100 parts by weight of the binder resin in the charge transporting layer.

* * * * *